US008231986B2

(12) United States Patent
Harada et al.

(10) Patent No.: US 8,231,986 B2
(45) Date of Patent: Jul. 31, 2012

(54) SPRAY COATING MEMBER HAVING EXCELLENT INJURY RESISTANCE AND SO ON AND METHOD FOR PRODUCING THE SAME

(75) Inventors: Yoshio Harada, Hyogo (JP); Takema Teratani, Hyogo (JP)

(73) Assignee: Tocalo Co., Ltd., Hyogo (JP)

( * ) Notice: Subject to any disclaimer, the term of this patent is extended or adjusted under 35 U.S.C. 154(b) by 742 days.

(21) Appl. No.: 11/990,760

(22) PCT Filed: Aug. 21, 2006

(86) PCT No.: PCT/JP2006/316788

§ 371 (c)(1),
(2), (4) Date: Feb. 21, 2008

(87) PCT Pub. No.: WO2007/023976

PCT Pub. Date: Mar. 1, 2007

(65) Prior Publication Data

US 2009/0120358 A1 May 14, 2009

(30) Foreign Application Priority Data

Aug. 22, 2005 (JP) ..... 2005-239523

(51) Int. Cl.
*B32B 19/00* (2006.01)
*B32B 9/00* (2006.01)
*B05D 1/04* (2006.01)

(52) U.S. Cl. ..... 428/702; 428/688; 428/689; 427/475; 427/532; 427/596

(58) Field of Classification Search ..... 428/688, 428/689, 701, 702; 427/475, 532, 596
See application file for complete search history.

(56) References Cited

U.S. PATENT DOCUMENTS

| | | | |
|---|---|---|---|
| 3,663,793 | A | 5/1972 | Petro et al. |
| 3,990,860 | A | 11/1976 | Fletcher et al. |
| 4,000,247 | A | 12/1976 | Yamada et al. |
| 4,205,051 | A | 5/1980 | Takahashi et al. |
| 4,219,359 | A | 8/1980 | Miwa et al. |
| 4,536,228 | A | 8/1985 | Treharne |
| 4,853,353 | A | 8/1989 | Whalen et al. |
| 4,997,809 | A | 3/1991 | Gupta |

(Continued)

FOREIGN PATENT DOCUMENTS

| | | |
|---|---|---|
| EP | 0822584 | 2/1998 |

(Continued)

OTHER PUBLICATIONS

U.S. Office Action mailed on Feb. 3, 2010 for corresponding U.S. Appl. No. 11/688,501.

(Continued)

*Primary Examiner* — David R Sample
(74) *Attorney, Agent, or Firm* — Greenblum & Bernstein, P.L.C.

(57) ABSTRACT

For the purpose of solving problems inherent to a white $Al_2O_3$ spray coating, i.e. drawbacks that the injury resistance, corrosion resistance, heat resistance, abrasion resistance and the like are poor and the light reflectance is high because the coating is porous and weak in the bonding force among particles, there are proposed a spray coating member having excellent injury resistance and the like in which a surface of a substrate is covered with a colored $Al_2O_3$ spray coating of a luminosity lower than grayish white, achromatic or chromatic color.

18 Claims, 5 Drawing Sheets

Before electron beam irradiation

Hue (Munsell)
N9. 25～N9. 5

After electron beam irradiation

Hue (Munsell)
2. 5Y 8／2

U.S. PATENT DOCUMENTS

| | | | | |
|---|---|---|---|---|
| 5,004,712 | A | 4/1991 | Borglum | |
| 5,024,992 | A | 6/1991 | Morris | |
| 5,032,248 | A | 7/1991 | Kanamaru et al. | |
| 5,057,335 | A | 10/1991 | Hanagata et al. | |
| 5,093,148 | A | 3/1992 | Christodoulou et al. | |
| 5,128,316 | A | 7/1992 | Agostinelli et al. | |
| 5,206,059 | A | 4/1993 | Marantz | |
| 5,316,859 | A | 5/1994 | Harada et al. | |
| 5,366,585 | A | 11/1994 | Robertson et al. | |
| 5,397,650 | A | 3/1995 | Harada et al. | |
| 5,427,823 | A | 6/1995 | Varshney et al. | |
| 5,432,151 | A | 7/1995 | Russo et al. | |
| 5,472,793 | A | 12/1995 | Harada et al. | |
| 5,562,840 | A | 10/1996 | Swain et al. | |
| 5,909,354 | A | 6/1999 | Harada et al. | |
| 5,922,275 | A | 7/1999 | Kageyama et al. | |
| 6,010,966 | A | 1/2000 | Ionov | |
| 6,045,665 | A | 4/2000 | Ohhashi et al. | |
| 6,120,640 | A | 9/2000 | Shih et al. | |
| 6,132,890 | A | 10/2000 | Harada et al. | |
| 6,156,151 | A | 12/2000 | Komino et al. | |
| 6,180,259 | B1 | 1/2001 | Harada et al. | |
| 6,250,251 | B1 | 6/2001 | Akiyama et al. | |
| 6,261,962 | B1 | 7/2001 | Bhardwai et al. | |
| 6,265,250 | B1 | 7/2001 | Yu | |
| 6,306,489 | B1 | 10/2001 | Hellmann et al. | |
| 6,319,419 | B1 | 11/2001 | Ohhashi et al. | |
| 6,326,063 | B1 | 12/2001 | Harada et al. | |
| 6,383,964 | B1 | 5/2002 | Nakahara et al. | |
| 6,447,853 | B1 | 9/2002 | Suzuki et al. | |
| 6,451,647 | B1 | 9/2002 | Yang et al. | |
| 6,509,070 | B1 | 1/2003 | Voevodin et al. | |
| 6,547,921 | B2 | 4/2003 | Suzuki et al. | |
| 6,558,505 | B2 | 5/2003 | Suzuki et al. | |
| 6,586,348 | B2 | 7/2003 | Hartner et al. | |
| 6,634,781 | B2 * | 10/2003 | Bowens et al. | 366/79 |
| 6,641,941 | B2 | 11/2003 | Yamada et al. | |
| 6,733,843 | B2 | 5/2004 | Tsukatani et al. | |
| 6,738,863 | B2 | 5/2004 | Butterworth et al. | |
| 6,771,483 | B2 | 8/2004 | Harada et al. | |
| 6,777,045 | B2 | 8/2004 | Lin et al. | |
| 6,783,863 | B2 | 8/2004 | Harada et al. | |
| 6,797,957 | B2 | 9/2004 | Kawakubo et al. | |
| 6,805,968 | B2 | 10/2004 | Saiti et al. | |
| 6,834,613 | B1 | 12/2004 | Miyazaki et al. | |
| 6,852,433 | B2 | 2/2005 | Maeda | |
| 6,884,516 | B2 | 4/2005 | Harada et al. | |
| 6,916,534 | B2 | 7/2005 | Wataya et al. | |
| 7,364,798 | B2 | 4/2008 | Harada et al. | |
| 7,494,723 | B2 | 2/2009 | Harada et al. | |
| 7,497,598 | B2 | 3/2009 | Masaki et al. | |
| 7,648,782 | B2 | 1/2010 | Kobayashi et al. | |
| 7,767,268 | B2 | 8/2010 | Harada et al. | |
| 7,850,864 | B2 | 12/2010 | Kobayashi | |
| 2004/0061443 | A1 | 4/2004 | Takeuchi et al. | |
| 2004/0214026 | A1 | 10/2004 | Harada et al. | |
| 2004/0216667 | A1 | 11/2004 | Mitsuhashi et al. | |
| 2005/0103275 | A1 | 5/2005 | Sasaki et al. | |
| 2005/0106869 | A1 | 5/2005 | Ooyabu et al. | |
| 2005/0136188 | A1 | 6/2005 | Chang | |
| 2006/0099444 | A1 | 5/2006 | Moriya et al. | |
| 2006/0099457 | A1 | 5/2006 | Moriya et al. | |
| 2006/0121293 | A1 | 6/2006 | Boutwell et al. | |
| 2006/0183344 | A1 | 8/2006 | Escher et al. | |
| 2007/0026246 | A1 | 2/2007 | Harada et al. | |
| 2007/0054092 | A1 | 3/2007 | Harada et al. | |
| 2007/0166477 | A1 | 7/2007 | Chang | |
| 2007/0215283 | A1 | 9/2007 | Kobayashi et al. | |
| 2007/0218302 | A1 | 9/2007 | Kobayashi et al. | |
| 2009/0120358 | A1 | 5/2009 | Harada et al. | |
| 2009/0130436 | A1 | 5/2009 | Harada et al. | |
| 2009/0208667 | A1 | 8/2009 | Harada et al. | |

FOREIGN PATENT DOCUMENTS

| | | |
|---|---|---|
| JP | 50-075370 | 6/1975 |
| JP | 58-192661 | 11/1983 |
| JP | 58-202535 | 11/1983 |
| JP | 59-96273 | 6/1984 |
| JP | 61-60658 | 2/1986 |
| JP | 61-104062 | 5/1986 |
| JP | 61-113755 | 5/1986 |
| JP | 62-253758 | 5/1987 |
| JP | 64-039728 | 2/1989 |
| JP | 1-139749 | 6/1989 |
| JP | 01-139749 | 6/1989 |
| JP | 03-115535 | 5/1991 |
| JP | 03-247769 | 11/1991 |
| JP | 04-202660 | 7/1992 |
| JP | 04-276059 | 10/1992 |
| JP | 05-117064 | 5/1993 |
| JP | 05-238859 | 9/1993 |
| JP | 06-057396 | 3/1994 |
| JP | 06-136505 | 5/1994 |
| JP | 06-142822 | 5/1994 |
| JP | 06-196421 | 7/1994 |
| JP | 06-220618 | 8/1994 |
| JP | 07-35568 | 4/1995 |
| JP | 7-35568 | 4/1995 |
| JP | 07-102366 | 4/1995 |
| JP | 07-126827 | 5/1995 |
| JP | 07-176524 | 7/1995 |
| JP | 08-037180 | 2/1996 |
| JP | 08-339895 | 12/1996 |
| JP | 9-48684 | 2/1997 |
| JP | 09-069554 | 3/1997 |
| JP | 09-69554 | 3/1997 |
| JP | 09-216075 | 8/1997 |
| JP | 09-272987 | 10/1997 |
| JP | 09-316624 | 12/1997 |
| JP | 9-316624 | 12/1997 |
| JP | 10-4083 | 1/1998 |
| JP | 10-045461 | 2/1998 |
| JP | 10-045467 | 2/1998 |
| JP | 10-144654 | 5/1998 |
| JP | 10-163180 | 6/1998 |
| JP | 10-202782 | 8/1998 |
| JP | 10-226869 | 8/1998 |
| JP | 10-330971 | 12/1998 |
| JP | 11-080925 | 3/1999 |
| JP | 11-207161 | 8/1999 |
| JP | 11-345780 | 12/1999 |
| JP | 2000-54802 | 2/2000 |
| JP | 2000-72529 | 3/2000 |
| JP | 3076768 | 6/2000 |
| JP | 2000-191370 | 7/2000 |
| JP | 2000-228398 | 8/2000 |
| JP | 2001-031484 | 2/2001 |
| JP | 2001-164354 | 6/2001 |
| JP | 2001-335915 | 12/2001 |
| JP | 2001-342553 | 12/2001 |
| JP | 2002-80954 | 3/2002 |
| JP | 2002-89607 | 3/2002 |
| JP | 2003-95649 | 4/2003 |
| JP | 2003-264169 | 9/2003 |
| JP | 2003-321760 | 11/2003 |
| JP | 2004-003022 | 1/2004 |
| JP | 2004-010981 | 1/2004 |
| JP | 2004-149915 | 5/2004 |
| JP | 2004-190136 | 7/2004 |
| JP | 2004-522281 | 7/2004 |
| JP | 2004-269951 | 9/2004 |
| JP | 2005-256098 | 9/2005 |
| JP | 2007-516921 | 6/2007 |
| KR | 10-0248081 | 4/2000 |
| KR | 10-2007-0030718 | 3/2007 |
| WO | 2004-095532 | 11/2000 |
| WO | 01-42526 | 6/2001 |
| WO | 03/003404 | 1/2003 |
| WO | 03-077300 | 9/2003 |
| WO | 2007/013184 | 1/2007 |
| WO | 2007/023971 | 1/2007 |
| WO | 2007/023971 | 3/2007 |
| WO | 2007/023976 | 3/2007 |

OTHER PUBLICATIONS

English language Abstract of JP 61-30658.
English language Abstract of JP 61-104062.
English language Abstract of JP 2004-269951.
English language Abstract of JP 1-139749.
English language Abstract of JP 9-48684.
English language Abstract of JP 9-316624.
English language Abstract of JP 2002-89607.
English language Abstract of JP 2001-342553.
English language Abstract of JP 2003-95649.
U.S. Appl. No. 12/293,974, filed Sep. 22, 2008 and entitled "Method for Manufacturing Ceramic Covering Member for Semiconductor Processing Apparatus, which is the National Stage of PCT/JP07/56122;".
English language Abstract of JP59-96273.
English language Abstract of JP 04-276059.
English language Abstract of JP 58-192661.
English language Abstract of JP 50-075370.
English language Abstract of JP 58-202535.
English language Abstract of JP 07-35568.
English language Abstract of JP 03-247769.
English language Abstract of JP 04-202660.
Series of JIS Manual, "Spray Coating Technical Manual," Oct. 30, 1998, p. 33; together with an English language translation thereof.
English language Abstract of JP 61-113755.
English language Abstract of JP 01-139749.
JIS Using Series, "Spraying Techniques Manual," Oct. 30, 1998, Japanese Standard Association, p. 95; together with an English language translation thereof.
English language abstract of JP 4-039728.
English language Abstract of corresponding JP Application Publication No. JP 62-142758.
English language abstract of KR 10-248081.
Magome, Masakatsu, "Series of JIS Manual Spray Coating Technical Manual," p. 33, Oct. 30, 1998, ISBN4-542-30381-0, issued by Japanese Standards Association with English translation.
Magome, Masakatsu, "JIS Using Series Spraying Technical Manual," p. 95, Oct. 30, 1998, ISBN4-542-30381-0, issued by Japanese Standards Association with English translation.
Magome, Masakatsu, "The p. 33 of Spray Coating Technical Manual," Series of JIS Manual, issued by Japanese Standards Association on Oct. 30, 1998, 7 pages including English translation.
Bibliographic data and abstract for KR 100268052 (which indicates that document also published as US Patent No. 5,909,354).
Office Action dated Jan. 25, 2012 in related U.S. Appl. No. 11/990,755.
Office Action dated Dec. 21, 2011 in related U.S. Appl. No. 12/499,588.
Office Action dated Sep. 12, 2011 in related U.S. Appl. No. 12/894,975.

* cited by examiner

FIG.1a Before electron beam irradiation
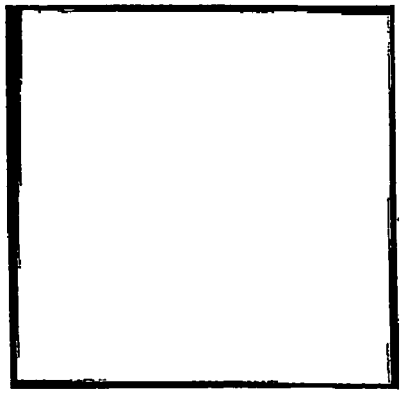
Hue (Munsell)
N9．25～N9．5
FIG.1b After electron beam irradiation
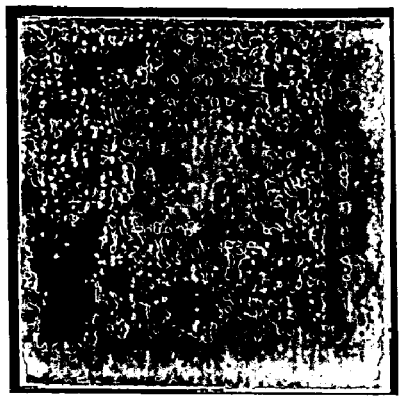
Hue (Munsell)
2．5Y 8／2

FIG.2a Surface
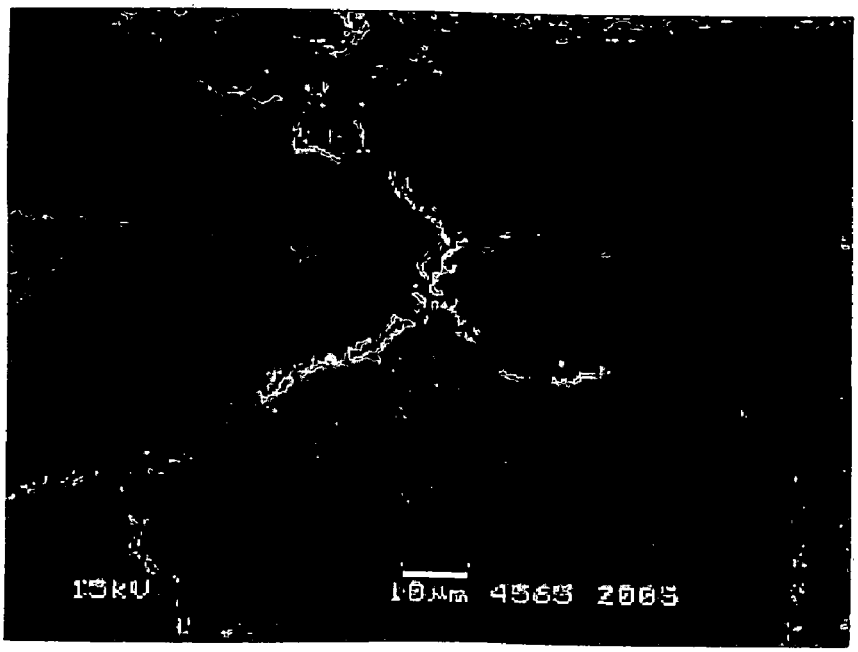
FIG.2b Section
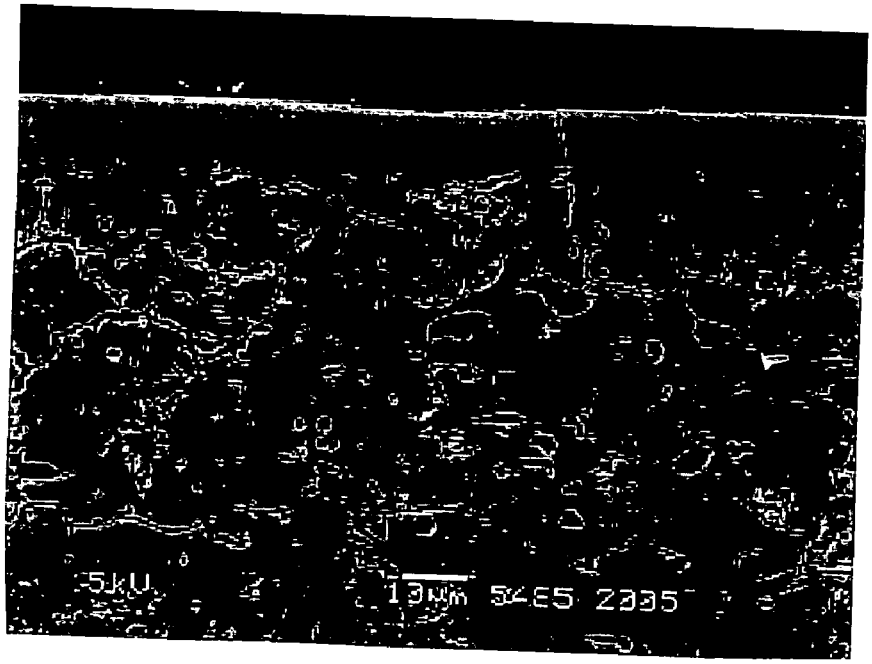

SPRAY COATING MEMBER HAVING EXCELLENT INJURY RESISTANCE AND SO ON AND METHOD FOR PRODUCING THE SAME

TECHNICAL FIELD

This invention relates to a spray coating member being excellent in various properties such as injury resistance, heat mission property, corrosion resistance, mechanical properties and the like as well as a method of producing the same, and more particularly to a technique for forming a colored spray coating with a luminosity lower than grayish white on a surface of a substrate.

RELATED ART

The spraying method is a surface treating technique wherein a spraying powdery material of a metal, ceramic, cermet or the like is fused by a plasma flame or a combustion flame of a combustible gas and the fused particles are accelerated and blown onto a surface of an objective (substrate) to be sprayed, whereby the fused particles are gradually deposited to form a coating having a certain thickness. In the spray coating formed by such a process, a great difference is caused in the mechanical properties and chemical properties of the coating depending on the strong or weak bonding force among the mutually deposited particles constituting the coating or the presence or absence of non-bonded particles. Therefore, the conventional spraying technique aims at the development that the bonding force among the mutually fused particles through the complete fusion of the spraying powder material is strengthened to diminish the non-fused particles and a large acceleration force is applied to the flying fused particles to generate strong impact energy on the surface of the objective to be sprayed to thereby increase the bonding force between the particles, whereby the porosity is decreased or the adhesion force to the objective to be treated (substrate) is strengthened.

For example, JP-A-H01-139749 proposes a method wherein the bonding force among mutually metal particles is improved or oxide film produced on the surface of the particle, which is a cause of generating pores, is reduced by a plasma spraying process under a reduced pressure of plasma-spraying the metal particles in an argon atmosphere of 50-200 hPa.

According to this technical development could be recently improved the characteristics of the spray coating such as mechanical strength and the like, but there is no technique of improving the heat emission property. Particularly, there is no thinking of improving the characteristics such as heat emission property and the like by adjusting the surface color of the spray coating. In this connection, a typical color of the ceramic spray coating is deep green near to black in, for example, chromium oxide ($Cr_2O_3$) powder as a spraying powdery material, but when it is subjected to a plasma spraying, a black coating is formed.

Thus, it is typically common that the color of the ceramic spray coating is reproduced as a color of a spray coating formed at a state of the color inherent to the spraying powder material. For example, aluminum oxide (shown by $Al_2O_3$) indicates white color in the powder material itself but also the spray coating formed by spraying the powder material. Particularly, $Al_2O_3$ is strong in the chemical bonding force between Al and $O_2$ as a main component as compared with the other oxide ceramics and indicates a white color even if the coating is formed by a plasma spraying process using a gas plasma flame composed mainly of Ar gas as a heat source (a great amount of electrons are included in the plasma).

In order to improve the bonding force of the porous metallic spray coating or among the mutual spraying particles, there is a method defined according to JIS H8303 (self-fluxing alloy spraying). This method is a re-melting method wherein a spray coating is formed and then only the spray coating is heated above a melting point thereof by oxygen-acetylene flame, a high frequency induction heating process, an electric furnace or the like.

As a method of increasing the bonding force among mutual spraying particles, there is a technique of irradiating electron beams or the like. For example, there are disclosed a method of irradiating electron beams or laser beams onto a metal coating to re-melt the coating for sealing in JP-A-S61-104062, a method of irradiating electron beams onto a surface of a carbide cermet coating or a metal coating to improve the performances of the coating in JP-A-H09-316624, and a method of irradiating short-wavelength light beams onto a ceramic for the formation of an electrical conductive portion to render into a metallic state through detachment of oxygen atom to thereby develop the electric conductivity in JP-H09-048684.

However, these conventional techniques target at the metal coating or carbide cermet coating and are to diminish pores in the coating or improve the adhesiveness, and the method of irradiating the short wavelength light beams onto the ceramic coating is also disclosed for giving the electric conductivity to the coating, but they are not intended to intentionally change the color of the coating.

It seems that the concept of the conventional technique on the electron beam irradiation is based on the premise of the thinking that the electrically conductive coating is required with the spraying material is treated with electron beams as described on paragraph [0011] of JP-A-H09-136624.

Further, JP-A-2002-89607 discloses a method wherein an electron beam heat source is used as a vapor source for heating $ZrO_2$ based ceramic material in the formation of a heat shield coating for a gas turbine to form a top coat having a columnar structure through PVD process. However, this method is a method for forming $ZrO_2$ based ceramic layer using the electron beam heat source, and is not a technique of re-melting the ceramic coating once formed.

DISCLOSURE OF THE INVENTION

The conventional $Al_2O_3$ spray coating is typically a white color inherent to the color of the spraying power material. As the inventors' experience, it is actual that this spray coating does not sufficiently correspond to the demand required in the field of recent sophisticated industry. That is, (1) In the white $Al_2O_3$ spray coating, the bonding force among $Al_2O_3$ particles is weak, and hence if the coating is subjected to shock from exterior such as blast erosion or the like, the particles are apt to be locally fallen down and hence the damage resistance of the coating is deteriorated from the fall-down portion as a starting of the breakage of the whole coating.

(2) The white $Al_2O_3$ spray coating is high in the light reflection ratio and could not be said to be suitable as a coating member in the field requiring the good heat emission ratio.

(3) Since colored particles are adhered to the white spray coating under environments of the members used requiring a high cleanness as in an interior of the semiconductor processing apparatus, it is required to repeat the cleaning at a frequency exceeding the given times, which brings about the decrease of operation efficiency and the rise of product cost.

(4) The white $Al_2O_3$ spray coating is a porous coating having a weak bonding force among the mutual particles and many voids (pores) because the contact area among the spraying particles constituting the coating are small. Therefore, although the $Al_2O_3$ particles themselves have an excellent corrosion resistance, environmental corrosive components (for example, water, acid, salts, halogen gas and so on) are easily penetrated into the pores of the coating and hence the corrosion of the substrate or the peeling of the coating are easily caused.

(5) The white $Al_2O_3$ spray coating is porous and has a weak bonding force among the particles and does not frequently pass through sufficient melting phenomenon in a hot spraying source. Therefore, it is easily etched during plasma etching or plasma cleaning treatment under an environment including fluorine gas, $O_2$ gas, fluoride gas or the like, and the durable life become short. Further, the coating particles after the plasma etching render into fine particles, which contaminate the environment and bring about the deterioration of the quality in the semiconductor product.

(6) Furthermore, the white $Al_2O_3$ spray coating can not be subjected to precision work because the bonding force among the mutual particles constituting the coating is weak and the particles are frequently fallen down in the mechanical work of the coating.

The invention is developed in view of the above-mentioned problems of the conventional techniques and is to provide a spray coating member of a composite oxide having an excellent injury resistance but also mechanical properties such as heat emission property, abrasion resistance and the like, chemical properties such as corrosion resistance and the like, resistance to plasma etching and so on.

The invention propose a spray coating member and a method of producing the same, which have the following summary and construction by further improving the conventional $Al_2O_3$ spray coating.

(1) A spray coating member having an excellent injury resistance and the like, which comprises a substrate and a colored spray coating of $Al_2O_3$ having a luminosity lower than grayish white (5Y 9/1) and achromatic (e.g. pearl gray N-7 or the like) or chromatic color (e.g. sand color 2.5Y 7.5/2 or the like) covering the surface of the substrate.

(2) A spray coating member having an excellent injury resistance and the like, wherein an undercoat made of a metal/alloy or cermet spray coating is disposed between the surface of the substrate and the colored spray coating.

(3) A spray coating member having an excellent injury resistance and the like, wherein the colored spray coating has a color formed by decreasing a luminosity of white color (about N-9.5) inherent to the spraying powder material or further changing hue and chromaticity to achromatic or chromatic color deeper than grayish white (5Y 9/1) through electron beam irradiating treatment or laser beam irradiating treatment.

(4) A spray coating member having an excellent injury resistance and the like, wherein the colored spray coating has a thickness of 50-2000 μm based on the deposition of $Al_2O_3$ spraying particles.

(5) A spray coating member having an excellent injury resistance and the like, wherein a portion of the colored spray coating ranging from the surface to less than 50 μm is a layer solidified after the re-melting through the electron beam irradiation or laser beam irradiation.

(6) A spray coating member having an excellent injury resistance and the like, wherein the undercoat is a spray coating of 50-500 μm in thickness made from at least one metal or an alloy selected from Ni and an alloy thereof, Mo and an alloy thereof, Ti and an alloy thereof, Al and an alloy thereof and Mg alloy, or a cermet of such a metal or alloy with a ceramic.

(7) A method of producing a spray coating member having an excellent injury resistance and the like, which comprises spraying a $Al_2O_3$ spraying powder material having a white color directly onto a surface of a substrate or onto a surface of an undercoat formed on the surface of the substrate, and then subjecting a surface of the thus obtained white $Al_2O_3$ spray coating to an electron beam irradiation or laser beam irradiation to change the color of the spray coating surface into an achromatic or chromatic color of a luminosity lower than grayish white (5Y 9/1).

(8) A method of producing a spray coating member having an excellent injury resistance and the like, wherein a layer of less than 50 μm located inward from the surface of the white $Al_2O_3$ spray coating is changed into an achromatic or chromatic color of a luminosity lower than grayish white (5Y 9/1) through the electron beam irradiation or the laser beam irradiation.

In the invention, the white $Al_2O_3$ spray coating is basically excellent in various properties, for example, resistance to plasma erosion in an atmosphere of a halogen or halogen compound gas, so that it can be preferably used as a member for recent semiconductor processing apparatus requiring a precise working accuracy and a clean environment, and hence it can largely contribute to improve the quality and productivity of semiconductor processed products. In addition, according to the invention, the surface color of the spray coating is rendered into a hue of sand color (2.5Y 7.5/2) or ash gray (2.5Y 6/1) and hence the injury resistance and the heat emission property are excellent, while when it is particularly subjected to the electron beam irradiation or laser beam irradiation, the surface of the coating becomes smooth and the $Al_2O_3$ spraying particles constituting the coating are fused together to form a dense coating, and hence the sliding property, corrosion resistance, abrasion resistance and the like are considerably improved, and it is possible to use the coating as a product in industrial fields over a long time.

Further, the colored $Al_2O_3$ spray coating according to the invention is desirable as a protection coating for a heating heater and the like requiring high heat emission property and heat receiving efficiency.

Moreover, according to the invention, the spray coating members having the above-mentioned properties can be advantageously produced by adopting the electron beam irradiation or laser beam irradiation.

BRIEF DESCRIPTION OF THE DRAWINGS

FIG. 1(*a*) is a photograph of a white $Al_2O_3$ spray coating formed by an atmospheric plasma spraying method of white $Al_2O_3$ powder material, and FIG. 1 (*b*) is a photograph of a colored $Al_2O_3$ spray coating formed by irradiating electron beams to the surface of the white $Al_2O_3$ spray coating to change into a sand color.

FIG. 2(*a*) is an optical microphotograph of a surface of $Al_2O_3$ spray coating after electron beam irradiation and FIG. 2(*b*) is an optical microphotograph of a section thereof.

BEST MODE FOR CARRYING OUT THE INVENTION

Figure 3A:
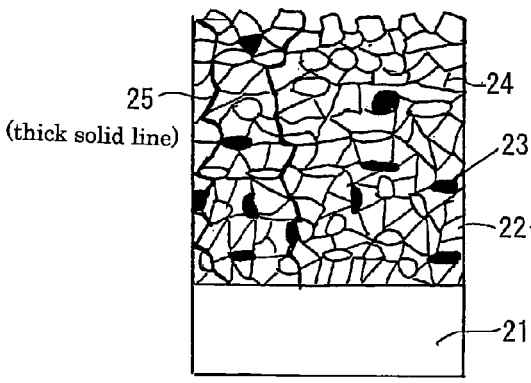
FIG. 3(*a*) is a schematic view of a section of $Al_2O_3$ spray coating before electron beam irradiation and FIG. 3(*b*) is a schematic view after electron beam irradiation.

In the invention, it is one of features that a white (N-9.5) coating inherent to an alumina ($Al_2O_3$) spraying powder material and a spray coating obtained by spraying this material is rendered into $Al_2O_3$ spray coating of achromatic (<N-9) or chromatic (<V-9) color (a value of a luminosity is small, low luminosity) deeper than grayish white (5Y 9/1). That is, the color of the spraying powder material (inherent color) is about N-9.5 (white or snow white) as Munsell system. However, the invention provides a spray coating having a color (color of small luminosity value) deeper than grayish white (5Y 9/1), for example, achromatic color such as pearl gray (N-7.0) or dull color (N-4.0), or a chromatic color with a luminosity of Munsell system of not more than V-8.5 (corresponding to N-8.5) which is a luminosity of ivory, more preferably not more than V-7.5, such as sand color (2.5Y 7.5/2), sky gray (7.5B 7.5/0.5), ash color (2.5Y 6/1), leaden color (2.5PB 5/1) or the like.

These colors can be realized by controlling the irradiation of electron beams or laser beams to a spray coating as mentioned later. Hereinafter, the spray coating added with the above color in the invention is called as a colored spray coating as compared with the inherent color spray coating (white).

Next, the production method of the colored $Al_2O_3$ spray coating of ivory or the like suitable for the invention will be described and also the features of the colored composite oxide spray coating will be explained.

(1) Method of Producing Members by Formation of $Al_2O_3$ Spray Coating

The $Al_2O_3$ spray coating is formed by roughening a surface of a body to be sprayed (substrate) through a blast treatment and applying a commercially available white $Al_2O_3$ spraying powder material directly onto the surface thereof or onto a surface of an undercoat made of a metal or an alloy or a cermet firstly formed on the surface of the substrate through a plasma spraying method or the like. The appearance of the spray coating is initially a white base coating likewise the spraying powder material.

In the invention, a spraying method such as an atmospheric plasma spraying method, a plasma spraying method under a reduced pressure, a high-speed flame spraying method, an explosion spraying method, a water plasma spraying method using water as a plasma source or the like can be applied to the formation of $Al_2O_3$ spray coating sprayed on the surface of the substrate. All of the appearances of $Al_2O_3$ spray coatings formed by these spraying methods are a white color system.

In the formation of the $Al_2O_3$ spray coating according to the invention, the undercoat is first formed on the surface of the substrate and then the coating may be formed thereon. In this case, it is preferable that at least one metal/alloy selected from Ni and an alloy thereof, Mo and an alloy thereof, Ti and an alloy thereof, Al and an alloy thereof and Mg alloy or a cermet with ceramics thereof is used as a material for the undercoat and is applied at a thickness of about 50-500 μm.

The undercoat plays a role for blocking the surface of the substrate from corrosive environment to improve the corrosion resistance but also improve the adhesion property between the substrate and $Al_2O_3$—$Y_2O_3$ composite oxide. Therefore, when the thickness of the undercoat is less than 50 μm, the action mechanism as the undercoat (chemical protection action for the substrate) is weak but also the uniform formation of the coating is difficult, while when the thickness of the undercoat exceeds 500 μm, the coating effect is saturated and the lamination working time is increased to bring about the rise of the production cost.

Also, the thickness of the $Al_2O_3$ spray coating always being a top coat is preferably within a range of about 50-2000 μm. When the thickness is less than 50 μm, the equality of the coating thickness is lacking and also the functions as the oxide ceramic coating, for example, resistance to erosion, resistance to plasma erosion, durability and the like can not be developed sufficiently. While, when the thickness exceeds 2000 μm, the bonding force among mutual particles constituting the coating becomes further weak and also the residual stress of the coating becomes large, and hence the strength of the coating itself lowers and the coating is easily broken even though the action of slight external force.

As the spraying powder material in the invention, powder having a particle size range of 5-80 μm formed by pulverizing the above alumina is used. When the particle size of the powder material is less than 5 μm, since the powder has no fluidity, it could not be evenly supplied to a spraying gun and the thickness of the spray coating becomes unequal. While, when the particle size exceeds 80 μm, the material is not completely fused in a spraying hot source, and hence the resulting coating becomes porous and the bonding forces among the mutual particles and adhesion force to the substrate become weak and the coating quality becomes rough, the bonding force to the substrate and the undercoat is undesirably deteriorated.

The substrate for the formation of the spray coating could be Al and Al alloy, corrosion-resistant steel such as stainless steel, Ti and an alloy thereof, ceramic sintered bodies (for example, oxide, nitride, boride, silicide, carbide and a mixture thereof), and raw materials such as quartz, glass, plastics and the like. Various plated layers or vapor deposit layer formed on these raw materials could be also used.

(2) Electron Beam or Laser Beam Irradiation Treatment for Coloration of $Al_2O_3$ Spray Coating According to the invention, electron beams or laser beams (hereinafter referred to as "electron beam or the like) are irradiated to the white $Al_2O_3$ spray coating having the same color as the $Al_2O_3$ spraying powder material. The electron beam irradiation treatment is a treatment for fusing $Al_2O_3$ particles on the surface of the coating together to conduct densification and also changing the color of the coating surface from white to at least ivory (2.5Y 8.5/1.%), preferably ash color (2.5Y 6/1), and it is applied for rendering the surface layer portion of the spray coating from white (N-9.5) to an achromatic color (N-9.0) having a slightly small N-value or a deeper chromatic color (grayish white: 5Y 9/1, ivory: 2.5Y 8.5/1.5 or the like).

Also, in the irradiation treatment of electron beam or the like, the surface layer portion of the $Al_2O_3$ spraying particles changed into ivory color is locally at a fused state through the irradiation of the beam, so that the coating surface tends to be smoothened as a whole. Further, in the formation of the spray coating, such factors could be eliminated as local particle dropout, increase of porosity and deterioration of corrosion resistance and abrasion resistance resulted from the presence of $Al_2O_3$ particles deposited at an unmolten state because the heating is not sufficiently conducted due to the lacking of a spray heat source.

Since the fusion and densification phenomenon of the spray coating are gradually extended from the surface into the inside by increasing the irradiation number of electron beam or the like, or prolonging the irradiation time, or increasing the output thereof, it is possible to control the molten depth by changing these conditions. Moreover, when the molten depth is practically about 50 μm, the coatings suitable for the object of the invention could be obtained.

As the condition for electron beam irradiation, the following conditions after an inert gas (Ar gas or the like) is introduced into an irradiation chamber discharging air are recommended, but not necessarily fulfilled if the irradiation effect can be obtained up to a depth of 50 μm from the surface of the spray coating.

Irradiating atmosphere: 10-0.0005 Pa
Irradiating power output: 0.1-8 kW
Irradiating speed: 1-30 m/s As the irradiation of the laser beams, it is possible to use YAG laser utilizing YAG crystal, or $CO_2$ gas laser or the like. As the laser beam irradiation treatment, the following conditions are recommended, but not necessarily fulfilled if the irradiation effect can be obtained up to a depth of 50 μm from the surface of the spray coating likewise the above-mentioned case.

Laser power output: 0.1-10 kW
Laser beam area: 0.01-2500 $mm^2$
Irradiating speed: 5-1000 mm/s FIG. 1 shows an appearance (a) of a white $Al_2O_3$ spray coating obtained by an atmospheric plasma spraying and an appearance (b) of a colored spray coating after electron beams are irradiated to the surface of the white spray coating, respectively.

Moreover, FIG. 1(*a*) shows that an atmosphere plasma is sprayed onto an aluminum substrate (A5052) having a width×length×thickness of 50×50×10 mm to form an $Al_2O_3$ spray coating having a thickness of 250 μm, which is then subjected to a plane polishing work, and FIG. 1(*b*) shows that electron beams are irradiated onto the surface of the spray coating of FIG. 1(*a*) under condition that an acceleration voltage is 28 kV and that an irradiating atmosphere is <0.1 Pa.

In the illustrated embodiment, the color of the $Al_2O_3$ spray coating is changed from N-9.25-0.5 (white) to 2.5Y 8/2 by the irradiation of electron beam or the like, which shows substantially sand color (2.5Y 7.5/2) or ash color (2.5Y 6/1).

Moreover, the causes for the color change of the $Al_2O_3$ spray coating surface irradiated by electron beam or the like are not sufficiently elucidated by the inventors, but they are considered by acting the following facts alone or compositely.

(I) In $Al_2O_3$ as a spraying powder material, the presence of slight amount of impurities contributes to coloration by subjecting to a heating and melting action through many electrons under a condition that an oxygen partial pressure is low as in the irradiation atmosphere of electron beam or the like.

(II) A part of a metallic member disposed in an irradiation chamber for electron beam or the like is changed into a slight amount of a colored fine dust by subjecting to the irradiation of electron beam or the like, which is incorporated into the molten surface of the spray coating.

(III) A part of oxygen in $Al_2O_3$ is locally removed to change into $Al_2O_{3-x}$ by irradiating many electrons having a low oxygen partial pressure and a strong reducing property in an irradiating atmosphere of electron beam or the like. However, the coloration of the white $Al_2O_3$ spray coating by the irradiation of electron beam or the like is obtained at a probability of 100% under the above irradiation conditions.

(3) Outline of Appearance and Section of $Al_2O_3$ Spray Coating Subjected to Irradiation of Electron Beam or the Like As the inventors' studies, the appearance of $Al_2O_3$ spray coating subjected to the irradiation treatment of electron beam or the like changes into a color such as grayish white, ivory, sand color, ash color or the like, while as the surface and section are observed by using an optical microscope (SEM-BEI image), small cracks were found in a network form (FIGS. 2(*a*), (*b*)). It is considered that the network-shaped cracks are generated when $Al_2O_3$ particles melted by irradiation of electron beam or the like are fused with each other to form a large smooth face and thereafter the volume is shrunk at the cooling stage. As seen from the section view of FIG. 2(*b*), the cracks generated on the surface of the $Al_2O_3$ coating and resulted from the heat shrinkage after the electron beam irradiation are limited to the surface and do not penetrate into the interior of the coating, so that they do not exert on the corrosion resistance of the coating. Moreover, crack-free irradiated face may be formed by pre-heating the irradiated portion or by slowly cooling after the irradiation.

On the other hand, a coating structure having many pores, which is inherent to the $Al_2O_3$ spray coating, remains in the underlayer portion below the electron beam irradiating influenced portion (portion of the coating changed by irradiation), so that such a coating structure is considered to advantageously act to thermal shock.

Figure 3B:
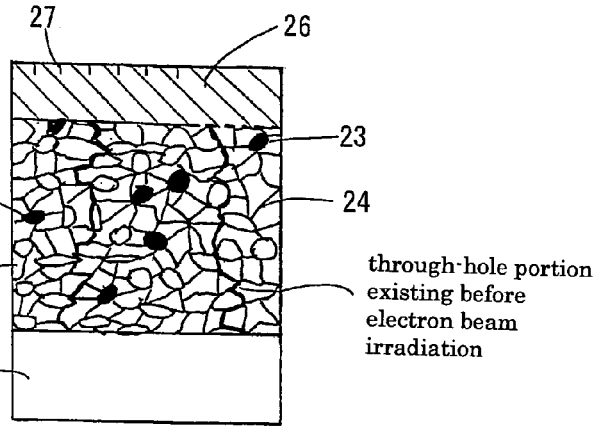
Figures 4A, 4B:
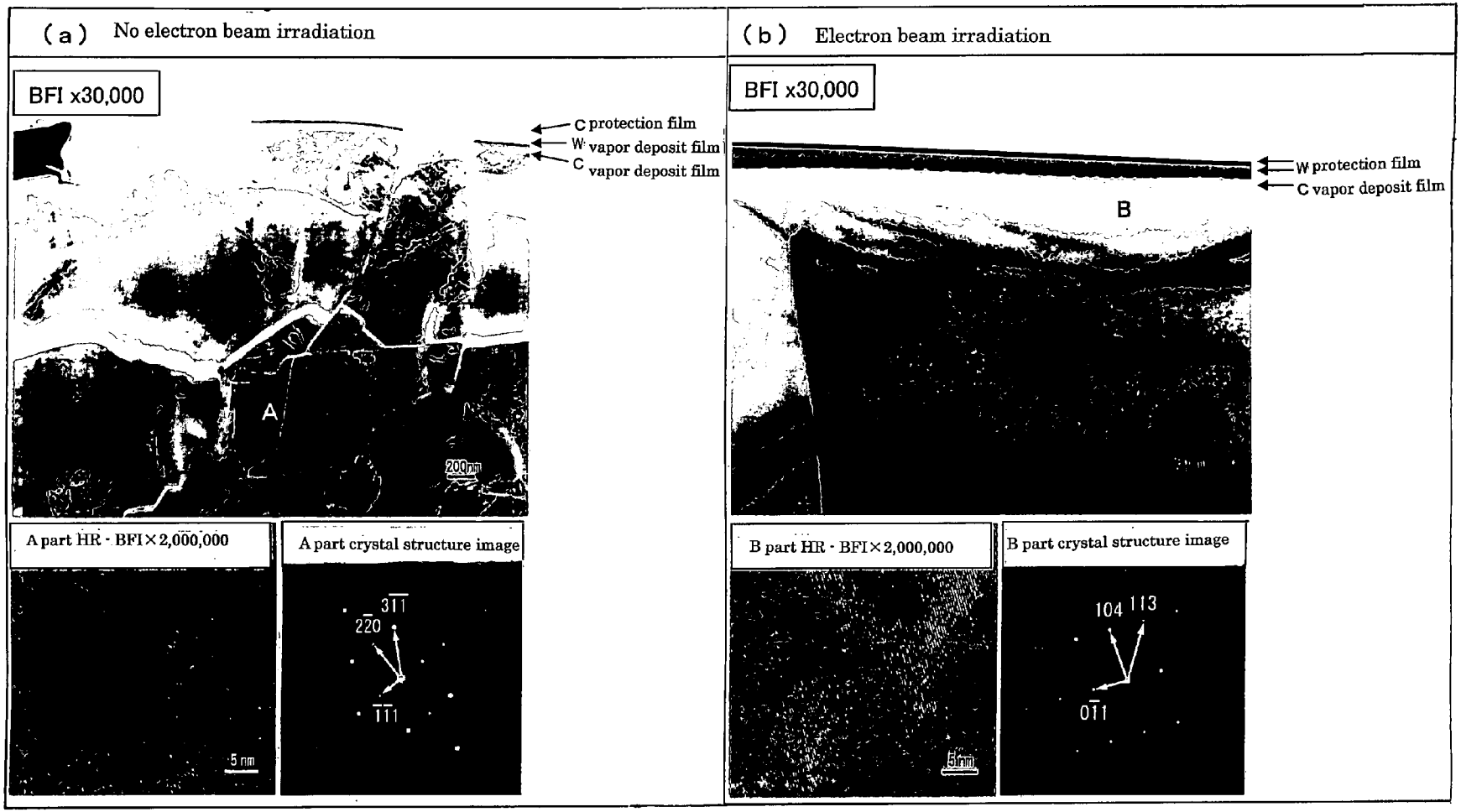
FIG. 4(*a*) is TEM photograph and crystal structure image of $Al_2O_3$ spray coating before electron beam irradiation and FIG. 4(*b*) is TEM photograph and crystal structure image after electron beam irradiation.

FIG. 3 schematically shows section states of a spray coating before and after electron beam irradiation (a) and (b), and further FIG. 4 shows TEM photographs and crystal structure images of $Al_2O_3$ spray coating section before and after electron beam irradiation (a) and (b), respectively. In the non-irradiated portion shown in FIGS. 3(*a*) and 4(*a*), the particles constituting the coating are independently deposited in the form of stone wall, and the surface roughness becomes large and the presence of various big and small gaps (pores) is observed. On the other hand, in the irradiated portion shown in FIGS. 3(*b*) and 4(*b*), a new layer having different microstructure is formed on the spray coating of the $Al_2O_3$—$Y_2O_3$ composite oxide particles. This layer is a dense layer having less gaps by fusing the spraying particles with each other.

Figure 5:
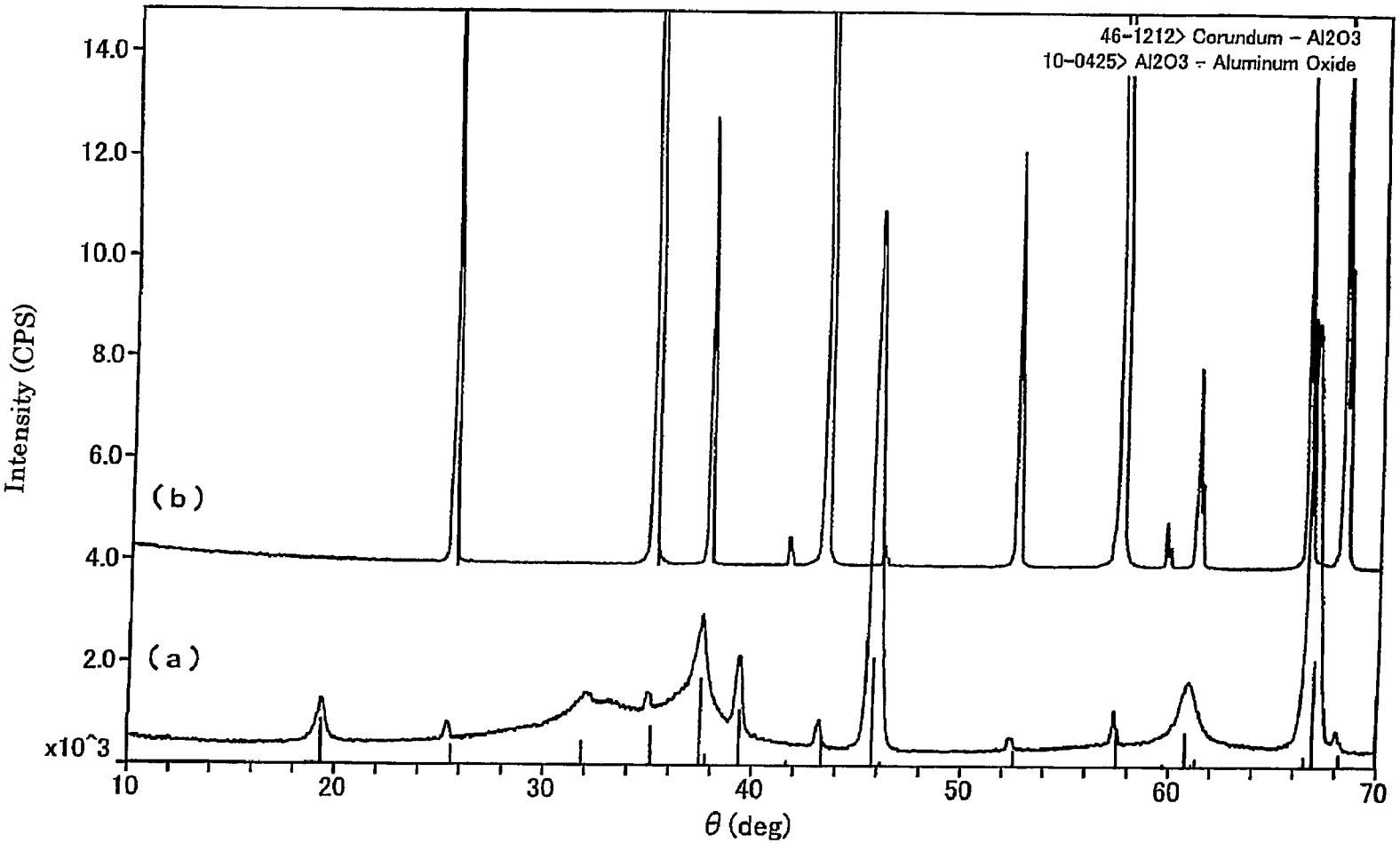
FIG. 5(*a*) is an X-ray diffraction pattern of $Al_2O_3$ spray coating before electron beam irradiation and FIG. 5(*b*) is an X-ray diffraction pattern after electron beam irradiation.

Furthermore, it is understood from the crystal structure image of FIG. 4 that the crystal form of $Al_2O_3$ particles constituting the coating is $\gamma$-$Al_2O_3$ (cubic system spinel) before the electron beam irradiation and is transformed into $\alpha$-$Al_2O_3$ (trigonal system steel beads type) by the electron beam irradiation. In addition, the crystal structures of the $Al_2O_3$ spray coating before electron beam irradiation and after electron beam irradiation are conformed by X-ray diffraction (FIG. 5). As a result, it can be confirmed that the crystal form of $Al_2O_3$ particles in the coating is transformed from $\gamma$-type to $\alpha$-type to improve the stability of the particles by electron beam irradiation.

Moreover, numeral 21 in FIG. 3 is a substrate, numerals 22 are $Al_2O_3$ particles constituting the coating, numerals 23 are gap portions of the coating, numerals 24 are grain boundary portions of $Al_2O_3$ particles, numeral 25 is a through-pore portion along the grain boundary, numeral 26 is a fused portion of $Al_2O_3$ particles through electron beam irradiation, and numerals 27 are fine heat-shrinkage cracks generated in the fused portion of $Al_2O_3$ particles.

(4) Features of $Al_2O_3$ Spray Coating Irradiated by Electron Beam or the Like

The colored $Al_2O_3$ spray coating according to the invention possesses the following functions without damaging physical and chemical properties of the conventional typical white $Al_2O_3$ spray coating formed by plasma spraying or the like (for example, it is hard and excellent in the abrasion resistance and has corrosion resistance and electric insulating property).

(a) The surface of the colored $Al_2O_3$ spray coating irradiated by electron beam or the like is completely melted once and integrally united by fusing $Al_2O_3$ particles of about 5-80 μm constituting the coating with each other, so that the mechanical strength in the vicinity of the surface of the spray coating (from the surface up to a depth of 50 μm) is improved and hence. the coating is hardly broken.

(b) The surface of the colored $Al_2O_3$ spray coating is considerably smoothened by the irradiation of electron beam or the like because the maximum roughness (Ry) of the surface before the irradiation treatment is 16-32 μm but the maximum roughness (Ry) after the irradiation treatment becomes about 6-18 μm owing to the melting phenomenon, and hence unmelted particles inherent to the spray coating or composite oxide particles convexly adhered thereto are discreated to improve the sliding property. Also, the mechanical working precision of the spray coating surface is improved, whereby spray coating members having a high precision could be produced.

(c) In the surface of $Al_2O_3$ spray coating irradiated by electron beam or the like, pores existing in the spray coating, particularly through-holes passing from the surface of the coating to the substrate are come off by the melting phenomenon, so that the corrosion resistance of not only the coating but also the substrate are improved dramatically.

(d) As previously mentioned, the $Al_2O_3$ spray coating irradiated by electron beam or the like changes from white color (N-9.5) just after the spraying into a color such as ivory (2.5Y 8.5/1.5) or the like, and hence light reflectance lowers and absorption efficiency of radiant heat is improved, so that a new evolution to members utilizing the change of color tone could be expected.

(e) In the surface of $Al_2O_3$ spray coating irradiated by electron beam or the like, the resistance to plasma erosion is considerably improved by the actions and effects of the above items (a)-(d). Therefore, when the colored $Al_2O_3$ spray coating irradiated by electron beam or the like according to the invention is applied to a surface of a member for semiconductor production-inspection-working apparatus requiring the clean environment, the resistance to plasma erosion is improved and the phenomenon of generating particles as an environmental contamination source lowers. As a result, the invention develops the remarkable effect in the maintenance of environment cleanness and largely contributes to the improvement of the productivity accompanied with the decrease of cleaning number of the apparatus.

(f) By the irradiation treatment of electron beam or the like, the crystal form of $Al_2O_3$ particles constituting the coating from $\gamma$-$Al_2O_3$ (cubic system spinel) are transformed to $\alpha$-$Al_2O_3$ (trigonal system steel beads type) to improve the stability of the particles at a crystal level.

(5) Thermal Spectral Properties of Colored $Al_2O_3$ Spray Coating

In the colored $Al_2O_3$ spray coating changed into a sand color (2.5Y 7.5/2) by the method of the invention, the thermal spectral properties change largely. This is clear from the following experiment conducted by the inventors. That is, a surface of a test piece of SUS 304 steel (size: width 30 mm×length 50 Mm×thickness 3.2 mm) is subjected to a blast treatment and then a spray coating of 120 μm in thickness is directly formed on such a surface by using white $Al_2O_3$ powder material through an atmospheric plasma spraying method. Thereafter, the surface of the spray coating is changed into a sand color by electron beam irradiation.

With respect to the thus obtained $Al_2O_3$ spray coating as a sample, spectral properties on wavelengths of 0.34-4 μm belonging to a range of visible zone to near-infrared zone are measured by using a Hitachi 323 model ultraviolet-visible spectrophotometer integrating sphere (for the measurement of diffuse reflection). In this measurement, since the sample is opaque, the absorption ratio (a) is determined according to the following equation by actually measuring the reflectance ($\gamma$) when the permeability is zero:

$$\text{Absorption ratio } (\alpha)=1-\gamma$$

Table 1 shows the test results. Since the white spray coating reflects greater part of the wavelengths to be tested, the absorption ratio (a) is about 0.05-0.1, while in the $Al_2O_3$ spray coating changed into sand color, the absorption ratio rises dramatically and shows 0.4-0.6. As compared with a case that an absorption ratio of $Cr_2O_3$ black spray coating used as a comparative example is about 0.9-0.92, it has been found that the spectral properties are largely influenced even in the sand color belonging to a slight coloration.

TABLE 1

| No. | Substrate | Spray coating material | Presence or absence of electron beam irradiation | Appearance color of coating before irradiation | Appearance color of coating after irradiation | Spectral properties (absorption ratio $\alpha$) | Remarks |
|---|---|---|---|---|---|---|---|
| 1 | SUS 304 | $Al_2O_3$ | absence | white | — | 0.05-0.1 | Comparative Example |
| 2 | | | presence | white | sand color | 0.4-0.6 | Invention Example |
| 3 | | $Cr_2O_3$ | absence | black | black | 0.9-0.92 | Comparative Example |

(Note)

(1) The spray coating material is a commercially available material having a purity of not less than 98.0 mass % for both $Al_2O_3$ and $Cr_2O_3$.

(2) The thickness of the thermally molten layer in the coating through electron beam irradiation is 2-3 μm.

(3) As to the spectral properties, the absorption ratio ($\alpha$) is determined according to the following equation by actually measuring the reflectance ($\gamma$) by means of a Hitachi 323 model ultraviolet-visible spectrophotometer integrating sphere under condition of wavelength: 0.34-4 μm:
Absorption ratio ($\alpha$) = 1 − $\gamma$

EXAMPLES

Example 1

After a one-side surface of SS400 steel test piece (size: width 50 mm×length 100 mm×thickness 3.2 mm) was subjected to a blast treatment, an $Al_2O_3$ spraying powder material was directly sprayed on the treated surface by an atmospheric plasma spraying method to form a spray coating of 150 μm in thickness. Thereafter, the surface of the $Al_2O_3$ spray coating was subjected to an electron beam irradiation treatment. In this case, spray coatings had been provided wherein the influence of electron beam irradiation was located at a distance from the surface of 3 μm, 5 μm, 10 μm, 20 μm, 30 μm or 50 μm by changing electric output of the electron beam irradiation, irradiation number and the like to control the molten state (melting depth) of $Al_2O_3$ particles on the surface of the spray coating.

pletely eliminate pores existing in the coating, particularly a part of through-holes extending to the substrate, which prevented salt water from arriving at the surface of the substrate through the interior of the coating.

Moreover, micro-cracks were existent even at the electron beam irradiated faces, but these cracks were found to be generated only on the surface portion when the molten $Al_2O_3$ spraying particles became shrunk by cooling and not a large crack extending to the substrate, therefore not affecting the corrosion resistance of the coating.

TABLE 2

| No. | Substrate | Spray coating material | Presence or absence of electron beam irradiation and influence depth thereof: presence or absence | Influence depth μm | Results of salt spray test: after 24 h | after 48 h | after 96 h | Remarks |
|---|---|---|---|---|---|---|---|---|
| 1 | SS400 | $Al_2O_3$ | absence | — | x | not carried out | not carried out | Comparative Example |
| 2 | | | presence | 3 | ○ | ○ | Δ | Invention Example |
| 3 | | | presence | 5 | ○ | ○ | Δ | Invention Example |
| 4 | | | presence | 10 | ○ | ○ | ○ | Invention Example |
| 5 | | | presence | 20 | ○ | ○ | ○ | Invention Example |
| 6 | | | presence | 30 | ○ | ○ | ○ | Invention Example |
| 7 | | | presence | 50 | ○ | ○ | ○ | Invention Example |

(Note)
(1) The thickness of the spray coating is 150 μm.
(2) The slat spray test was carried out according to JIS Z2371.
(3) Symbols in the results of the salt spray test mean the following contents. ○: no red rust, Δ: occurrence of red rust at less than 3 places, x: occurrence of red rust over full face Onto the exposed part of the substrate such as side face and rear face of the test piece after the electron beam irradiation, a paint having a corrosion resistance was applied, which was subjected to a slat spray test defined according to JIS Z2371 to examine the corrosion resistance of the spray coating.

Further, as $Al_2O_3$ spray coating of Comparative Example, an atmospheric plasma spray coating not irradiated by electron beams was subjected to the slat spray test.

Moreover, the electron beam irradiation apparatus used in this example had the following specifications.

Output of electron beams: 6 kW
Acceleration voltage: 30-60 kV
Beam current: 5-100 mA
Beam diameter: 400-1000 μm
Irradiation atmosphere pressure: 6.7-0.27 Pa
Irradiation distance: 300-500 mm Table 2 summarizes the results of the salt spray test. As seen from these results, many pores inherent to the ceramic spraying were existent in the $Al_2O_3$ spray coating of the comparative example (No. 1), so that red rust was generated over the full surface of the test piece after 24 hours, and the subsequent test had been stopped.

On the contrary, the occurrence of red rust had not been observed in the test pieces irradiated by electron beams (No. 2-No. 7) after 48 hours. Only in the test pieces (No. 2 and No. 3) having a thin thickness of molten layer on the surface of the coating through the electron beam irradiation, the occurrence of small red rust had been first observed in 2-3 places after the 96 hours, while the other test pieces did not show the occurrence of red rust at all.

As seen from the above results, it had been found that the $Al_2O_3$ spray coating irradiated by electron beams was melted and fused together at its surface by electron beams to com-

Example 2

In this example, a one-side surface of a test piece of SUS 304 steel (size: width 50 mm×length 60 mm×thickness 3.2 mm) was subjected to a blast treatment, and thereafter a coating was directly formed at a thickness of 150 μm on the surface thereof by spraying white $Al_2O_3$ particles through an atmospheric plasma spraying method, or an undercoat of 80 mass % Ni-20 mass % Cr alloy was formed at a thickness of 150 μm by an atmospheric plasma spraying and then an $Al_2O_3$ spray coating as a top coat was formed on the undercoat at a thickness of 150 μm by an atmospheric plasma spraying method. Thereafter, the surfaces of these $Al_2O_3$ spray coatings were subjected to a densification treatment by irradiating electron beams. Moreover, $Al_2O_3$ spray coating not irradiated by electron beam was provided as a comparative example and subjected to a thermal shock test under the same conditions to measure occurrence of cracks in the composite oxide spray coating as a top coat and presence or absence of the peeling.

In the thermal shock test, the test piece had been placed in an electric furnace adjusted to 500° C. for 15 minutes and then charged into a tap water of 20° C. This operation was one cycle, and repeated in 5 cycles while the appearance state of the top coat was observed every cycle. The number of the test pieces was three per one condition, and a case that cracks were generated in one test piece is shown by "⅓ crack occurrence".

Table 3 summarizes the above results. As seen from these results, The $Al_2O_3$ spray coating formed on the undercoat above the substrate developed good resistance to thermal shock irrespectively of the presence or absence of the electron beam irradiation and defects such as cracks or the like were not observed on the top coat.

On the contrary, in the $Al_2O_3$ spray coatings directly formed on the substrate as a top coat (No. 1 and 2), when electron beams were not irradiated, cracks were generated in two test pieces among three test pieces (shown by ⅔), so that the resistance to thermal shock was found to be poor.

From these results, it is clear that the densification of the $Al_2O_3$ spray coating through the electron beam irradiation were limited to be in the vicinity of the surface of the coating and that the interior of the coating was maintained at a state of having many pores. Moreover, it is understood that at least the application of the undercoat had been effective for improving the resistance to thermal shock in these coatings.

TABLE 3

| | | Spray coating material | | Presence or absence of electron beam irradiation and influence depth thereof | | Results of thermal shock test (500° C. × 15 min) ↔ | |
|---|---|---|---|---|---|---|---|
| No. | Substrate | undercoat | top coat | presence or absence | influence depth (μm) | charging into water, 5 cycles | Remarks |
| 1 | SUS 304 | absence | $Al_2O_3$ | absence | — | 2/3 crack, partly peeling | Comparative Example |
| 2 | | | $Al_2O_3$ | presence | 5 | 1/3 crack | Invention Example |
| 3 | | presence | $Al_2O_3$ | absence | — | no crack and peeling | Comparative Example |
| 4 | | | $Al_2O_3$ | presence | 5 | no crack and peeling | Invention Example |
| 5 | | presence | $Al_2O_3$ | absence | — | no crack and peeling | Comparative Example |
| 6 | | | $Al_2O_3$ | presence | 10 | no crack and peeling | Invention Example |

(Note)
(1) Each of undercoat (80Ni—20Cr) and top coat ($Al_2O_3$) are formed at a thickness of 150 μm by an atmospheric plasma spraying method.
(2) Meaning of fractional number in column of "Result of thermal shock test"
1/3 means that crack or peeling is caused in one top coat ($Al_2O_3$) among three test pieces.

Example 3

In this example a resistance to fluorine gas in the sand-colored $Al_2O_3$ spray coating irradiated by electron beam was examined. On a one-side surface of a test piece of SUS 304 steel (size: width 30 mm×length 50 mm×thickness 3.2 mm) as a substrate, a white $Al_2O_3$ spraying powder material in an atmospheric plasma was directly plasma sprayed to form a white $Al_2O_3$ spray coating having a thickness of 150 μm. Thereafter, the spray coating was melted within a range of 5 μm from the surface and densified by an electron beam irradiation treatment to form a colored spray coating having a sand color.

The test piece having the thus treated colored spray coating was placed in an autoclave wherein air was removed and HF gas was introduced so as to have a partial pressure of 100 hPa, and then the autoclave was heated to 300° C. to conduct a continuous corrosion test of 100 hours. Moreover, the same test was conducted under the same conditions on the substrate (SUS 304) and the white $Al_2O_3$ spray coating not irradiated by electron beam as a comparative example.

Table 4 shows the results. In No. 1 spray coating (comparative example), the substrate of SUS 304 steel was violently corroded by HF gas to generate fine red rusts over a full face of the test piece. Also, in the white $Al_2O_3$ spray coating not irradiated by electron beam (No. 2), the coating itself was sound, but was completely peeled off from the substrate of SUS 304 steel, and hence the occurrence of red rust was observed on the surface of the substrate.

From this result, it is considered that the joint force between the substrate and the coating in the $Al_2O_3$ spray coating not irradiated by electron beam was lost due to the corrosion of the substrate with HF gas penetrated inward through pore portions of the coating.

On the contrary, in the $Al_2O_3$ spray coatings changed into ivory color by electron beam irradiation, it is considered that the higher corrosion resistance was developed because the through-holes extending to the substrate were very less and the peeling of the coating was not caused though micro-cracks generated in the cooling solidification from the molten state were existent on the surface of the coating irradiated by electron beam.

TABLE 4

| | | | Presence or absence of | Appearance of coating | | Result of corrosion test | |
|---|---|---|---|---|---|---|---|
| No. | Substrate | Spray coating material | electron beam irradiation | before irradiation | after irradiation | HF gas-300° C.-100 h | Remarks |
| 1 | SUS 304 | — | — | — | — | occurrence of red rust over full face | Comparative Example |
| 2 | | $Al_2O_3$ | absence | white | — | peeling of coating | Comparative Example |

TABLE 4-continued

| No. | Substrate | Spray coating material | Presence or absence of electron beam irradiation | Appearance of coating before irradiation | Appearance of coating after irradiation | Result of corrosion test HF gas-300° C.-100 h | Remarks |
|---|---|---|---|---|---|---|---|
| 3 | | | presence | white | sand color | occurrence of red rust at one place. no peeling of coating | Invention Example |
| 4 | | | presence | white | sand color | no peeling of coating | Invention Example |

(Note)

(1) Thickness is 150 μm in atmospheric plasma spraying method.

(2) Thickness of molten layer in the coating through electron beam irradiation is 5 μm.

Example 4

In this example, resistance to plasma erosion of the colored $Al_2O_3$ spray coating irradiated by electron beam according to the invention was examined. As an electron beam irradiated test piece, the same as in Example 3 was used, which was subjected to a continuous treatment at a plasma output of 80 W for an irradiating time of 500 minutes using a reactive plasma etching apparatus in an atmosphere consisting of 60 ml/min of $CF_4$ gas and 2 ml/min of $O_2$. Moreover, as a test piece of a comparative example, $Al_2O_3$ spray coating formed by atmospheric plasma spraying and $SiO_2$ spray coating were tested under the same conditions.

Table shows the test results. The plasma erosion quantity of the $Al_2O_3$ spray coating as the comparative example was 1.2-1.4 μm, while the erosion quantity of the colored $Al_2O_3$ spray coating irradiated by electron beam was reduced to 25-40%, from which it is clear that the resistance to erosion had been improved by densification of the surface of the spray coating. Moreover, the $SiO_2$ coating as another comparative example was easily subjected to a chemical action of $CF_4$ gas, and showed its erosion quantity as 20-25 μm, which was maximum among those of the tested coatings, from which it is confirmed that the latter coating could not be used under this type of the environment.

Example 5

In this example, the abrasion resistance was compared between the Colored $Al_2O_3$ spray coating showing a sand color (2.5Y 7.5/2) and the spray coating not irradiated by electron beam using the test piece of Example 2. The test apparatus and conditions thereof are as follows.

Test method: reciprocal moving abrasion test method defined according to a test method for abrasion resistance of a plating of JIS H8503 Test conditions: load of 3.5 N, 10 minutes (400 times) and 20 minutes (800 times) at a reciprocal speed of 40 times/min, abrasive area 30×12 mm, abrasion test paper CC320

The evaluation was conducted by measuring weights of the test piece before and after the test and quantifying an abrasion quantity from the difference thereof.

Moreover, a case that the $Al_2O_3$ atmospheric plasma spray coating was not subjected to an electron beam irradiation is shown as a comparative example in this test (No. 1).

The test results are shown in Table 6. As seen from the results, the sand-colored $Al_2O_3$ spray coatings (No. 2 and 3) as an invention example developed an excellent abrasion resistance suitable for the invention because the weight reduction quantity associated with the abrasion was about 40-50% of the abrasion quantity of the comparative example.

TABLE 5

| No. | Substrate | Spray coating material | Presence or absence of electron beam irradiation and influence depth thereof: presence or absence | influence depth (μm) | Plasma erosion depth (μm) | Remarks |
|---|---|---|---|---|---|---|
| 1 | SUS 304 | $Al_2O_3$ | absence | — | 1.2-1.4 | Comparative Example |
| 2 | | | presence | 3 | 0.5-0.75 | Invention Example |
| 3 | | | presence | 10 | 0.4-0.70 | Invention Example |
| 4 | | $SiO_2$ | absence | — | 20-25 | Comparative Example |

(Note)

(1) Thickness of $Al_2O_3$ spray coating was 150 μm.

(2) The surface of the spray coating was mirror-polished for the testing.

(3) The erosion depth was measured at three places of the test piece surface and shown by a range of the measured values.

Moreover, this result is considered to include the improvement of smoothness on the surface of t he coating through electron beam irradiation, bonding force among mutual $Al_2O_3$ particles constituting the coating, and so on.

TABLE 6

| No. | Spraying method | Appearance color of coating | Presence or absence of undercoat | Presence or absence of electron beam irradiation and color of coating: presence or absence of irradiation | Presence or absence of electron beam irradiation and color of coating: appearance color | Porosity of coating (%) | Weight reduction quantity by abrasion test (mg): after 400 times | Weight reduction quantity by abrasion test (mg): after 800 times | Remarks |
|---|---|---|---|---|---|---|---|---|---|
| 1 | Atmospheric plasma spraying | white | presence | absence | white | 3-8 | 38-57 | 72-91 | Comparative Example |
| 2 | | white | presence | Presence (3 μm) | sand color | 0.1-0.3 | 18-30 | 30-38 | Invention Example |
| 3 | | white | presence | Presence (5 μm) | sand color | 0.1-0.2 | 18-28 | 28-39 | Invention Example |

(Note)

(1) Three test pieces per one test, numeral in the column of "presence or absence of electron beam irradiation" shows a thickness of molten layer in the coating.

(2) In the coating, thickness of undercoat (80Ni—20Cr) is 100 μm and thickness of $Al_2O_3$—$Y_2O_3$ composite oxide as a top coat is 180 μm.

(3) The porosity of the coating was measured by an image analyzing apparatus for coating section.

(4) The abrasion-resistant test of the coating was carried out by a reciprocal moving abrasion test method defined according to a test method for abrasion resistance of a plating of JIS H8503.

INDUSTRIAL APPLICABILITY

The technique of the invention can be widely utilized in industrial fields of using $Al_2O_3$ spray coatings. Also, the technique of the invention could be used as a protection coating for a heater or a coating for a heat receiving plate because the effect of absorbing radiant heat is high. Furthermore, the technique of the invention is effectively used as a material for precision machine parts because the flat plane property based on the fusion bonding of particles constituting the spray coating formed on the surface of the substrate is excellent and the surface precision finish through mechanical work is possible. Moreover, it is preferably used as a protection technique for members in semiconductor working-producing-inspecting apparatus or members in liquid crystal producing apparatus which conduct plasma etching reaction in a gas atmosphere of a halogen or a halogen compound.

The invention claimed is:

1. A spray coating member having an excellent injury resistance, which comprises a substrate and a colored spray coating of $Al_2O_3$, changed into $Al_2O_{3-X}$, wherein X is greater than 0 and less than 3, by irradiating electrons having a low oxygen partial pressure and a strong reducing property in an irradiating atmosphere of an electron beam, which has a chromatic color with a luminosity of Munsell system of less than N-9, or an achromatic color with a luminosity of Munsell system of less than V-9 covering the surface of the substrate.

2. A spray coating member having an excellent injury resistance according to claim 1, wherein an undercoat made of a metal/alloy or cermet spray coating is disposed between the surface of the substrate and the colored spray coating.

3. A spray coating member having an excellent injury resistance according to claim 1, wherein the colored spray coating has a thickness of 50-2000 μm based on the deposition of $Al_2O_3$ spraying particles.

4. A spray coating member having an excellent injury resistance according to claim 1, wherein a portion of the colored spray coating from the surface to less than 50 μm is a layer solidified after the re-melting through the electron beam irradiation.

5. A spray coating member having an excellent injury resistance according to claim 2, wherein the undercoat is a spray coating of 50-500 μm in thickness made from at least one metal or an alloy selected from Ni and an alloy thereof, Mo and an alloy thereof, Ti and an alloy thereof, Al and alloy thereof and Mg alloy, or a cermet of such a metal or alloy with a ceramic.

6. A method of producing a spray coating member having an excellent injury resistance, which comprises spraying $Al_2O_3$ spraying powder material having a white color directly onto a surface or onto a surface of an undercoat formed on the surface of the substrate, and then subjecting a surface of the thus obtained white $Al_2O_3$ spray coating to an electron beam irradiation to change the color of the spray coating surface into an $Al_2O_{3-X}$, wherein X is greater than 0 and less than 3, and an achromatic or chromatic color with a luminosity of Munsell system of less than N-9 or less than V-9.

7. A method of producing a spray coating member having an excellent injury resistance according to claim 6, wherein a layer of less than 50 μm located inward from the surface of the white $Al_2O_3$ spray coating is changed into an $Al_2O_{3-X}$ and an achromatic or chromatic color with a luminosity of Munsell system of less than N-9 or less than V-9 through the electron beam irradiation.

8. A spray coating member having an excellent injury resistance according to claim 2, wherein the colored spray coating of $Al_2O_3$ covering the surface of the substrate has a chromatic color with a luminosity of Munsell system of less than N-9, or an achromatic color with a luminosity of Munsell system of less than V-9.

9. A spray coating member having an excellent injury resistance according to claim 2, wherein the colored spray coating has a thickness of 50-2000 μm based on the deposition of $Al_2O_3$ spraying particles.

10. A spray coating member having an excellent injury resistance according to claim 1, wherein the colored spray coating has a thickness of 50-2000 μm based on the deposition of $Al_2O_3$ spraying particles.

11. A spray coating member having an excellent injury resistance according to claim 8, wherein the colored spray coating has a thickness of 50-2000 μm based on the deposition of $Al_2O_3$ spraying particles.

12. A spray coating member having an excellent injury resistance according to claim 2, wherein a portion of the colored spray coating ranging from the surface to less than 50 μm is a layer solidified after the re-melting through the electron beam irradiation.

13. A spray coating member having an excellent injury resistance according to claim 1, wherein a portion of the colored spray coating ranging from the surface to less than 50 μm is a layer solidified after the re-melting through the electron beam irradiation.

14. A spray coating member having an excellent injury resistance according to claim 8, wherein a portion of the colored spray coating ranging from the surface to less than 50 μm is a layer solidified after the re-melting through the electron beam irradiation.

15. A spray coating member having an excellent injury resistance according to claim 3, wherein a portion of the colored spray coating ranging from the surface to less than 50 μm is a layer solidified after the re-melting through the electron beam irradiation.

16. A spray coating member having an excellent injury resistance according to claim 9, wherein a portion of the colored spray coating ranging from the surface to less than 50 μm is a layer solidified after the re-melting through the electron beam irradiation.

17. A spray coating member having an excellent injury resistance according to claim 10, wherein a portion of the colored spray coating ranging from the surface to less than 50 μm is a layer solidified after the re-melting through the electron beam irradiation.

18. A spray coating member having an excellent injury resistance according to claim 11, wherein a portion of the colored spray coating ranging from the surface to less than 50 μm is a layer solidified after the re-melting through the electron beam irradiation.

* * * * *